United States Patent [19]

Beverstock

[11] 3,958,616

[45] May 25, 1976

[54] PURSE APPARATUS

[76] Inventor: Jean E. Beverstock, 1511 Nuuanu Ave., Honolulu, Hawaii

[22] Filed: Jan. 15, 1974

[21] Appl. No.: 433,440

[52] U.S. Cl. ..... 150/30; 150/28 R
[51] Int. Cl.[2] ..... A45C 13/00
[58] Field of Search ..... 150/28 R, 30, 35, 47, 150/36; 190/61

[56] References Cited

UNITED STATES PATENTS

| | | | |
|---|---|---|---|
| 1,213,758 | 1/1917 | Delaney | 150/47 |
| 1,479,591 | 1/1924 | L'Enfant | 150/30 |
| 1,679,807 | 8/1928 | Bohl | 150/35 |
| 1,983,266 | 12/1934 | Berkowitz | 150/30 |
| 2,330,402 | 9/1943 | Winokar | 150/30 |
| 2,477,388 | 7/1949 | Moore | 150/30 |
| 2,529,724 | 11/1950 | Conwiser | 150/28 R |
| 2,624,385 | 1/1953 | Hogan | 150/30 |
| 2,636,532 | 4/1953 | Putt | 150/28 R |
| 3,286,751 | 11/1966 | Dishart | 150/35 |

FOREIGN PATENTS OR APPLICATIONS

| | | | |
|---|---|---|---|
| 743,798 | 10/1966 | Canada | 150/47 |

*Primary Examiner*—R. E. Hart
*Attorney, Agent, or Firm*—James C. Wray

[57] ABSTRACT

Purse apparatus has an insert with rigid side walls hinged to a bottom wall, and with flexible end walls joining the sidewalls. Portions of the side walls project up above the end walls for fitting under inverted pockets in upper inside edges of flexible bags. A flap connected to one upper side edge of the bag draws the upper side edges of the bag and insert together and fastens on the opposite side of the bag. A false flap continues from the flap downward over the first side of the bag to foil would-be pickpockets. A chain extends from the wrist of a wearer to an anchor in the insert. Sharply pulling on the chain activates an alarm.

11 Claims, 9 Drawing Figures

FIG. 1
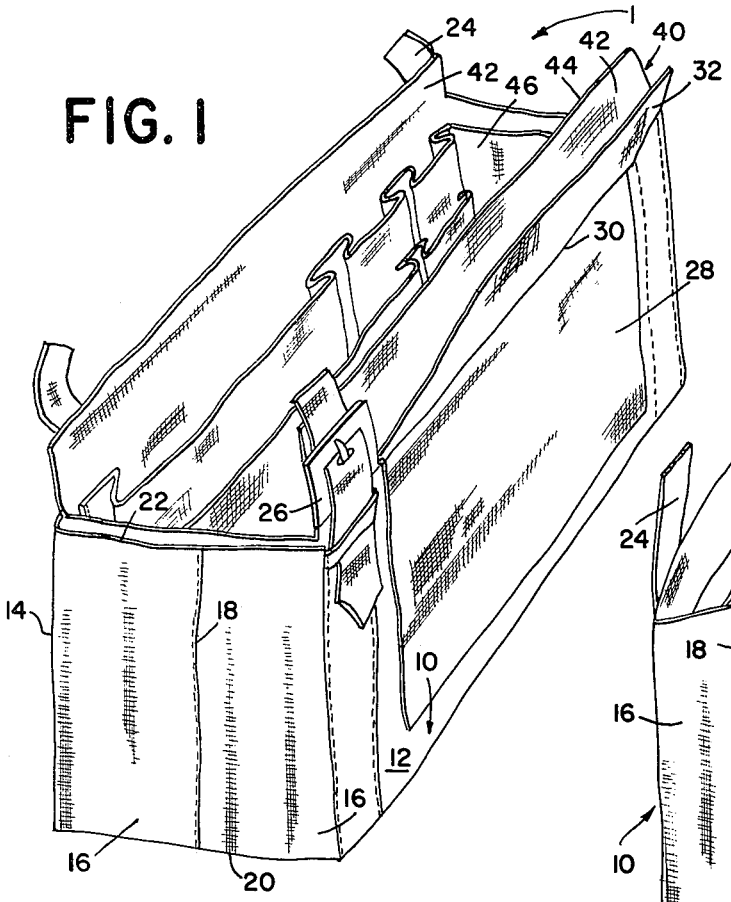
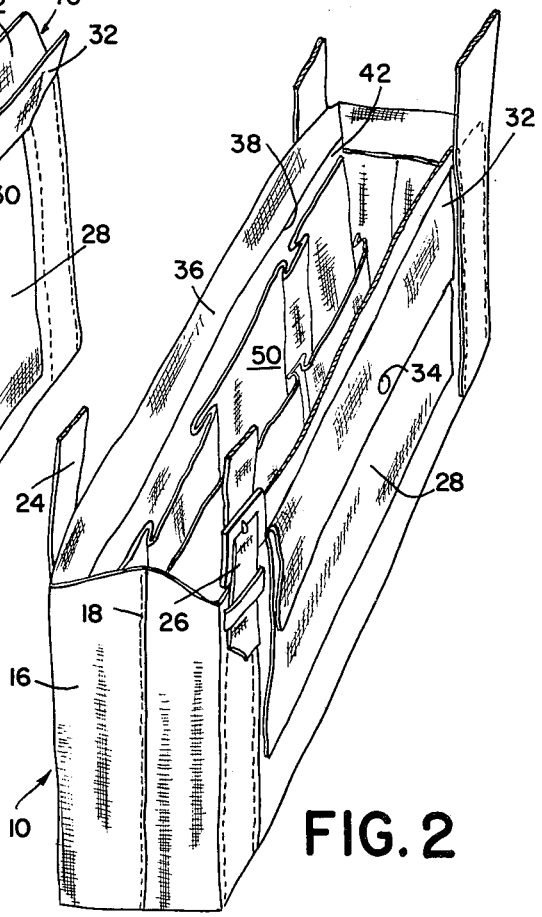
FIG. 2
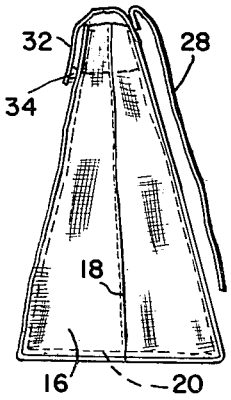
FIG. 3
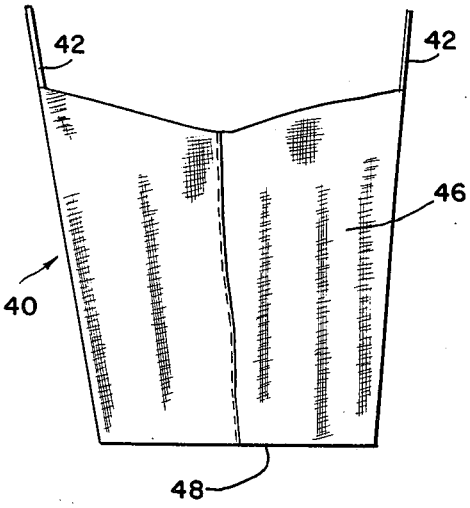
FIG. 4

FIG. 5
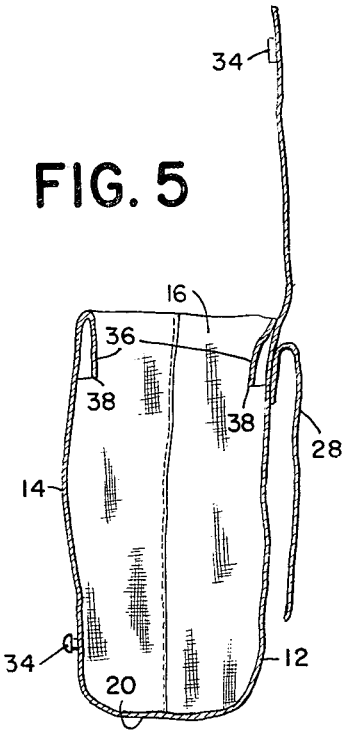
FIG. 6
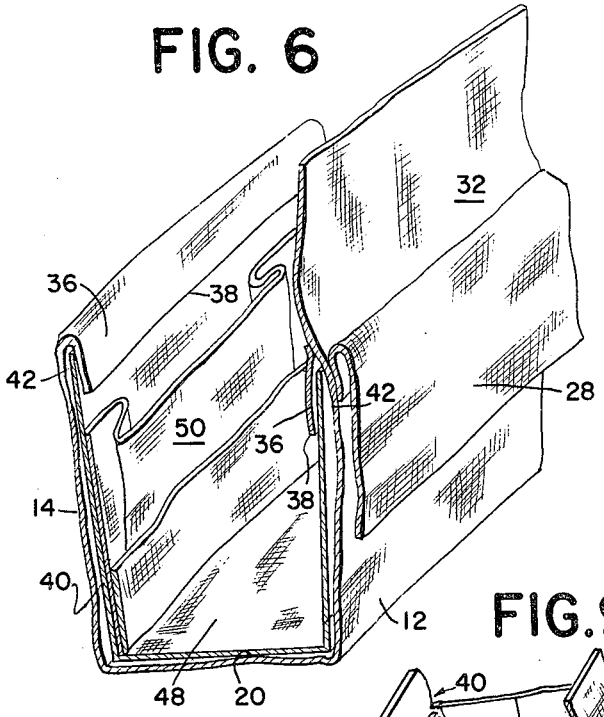
FIG. 9
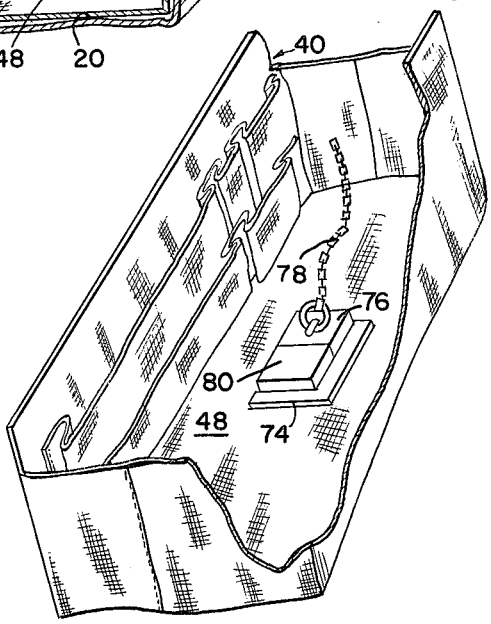
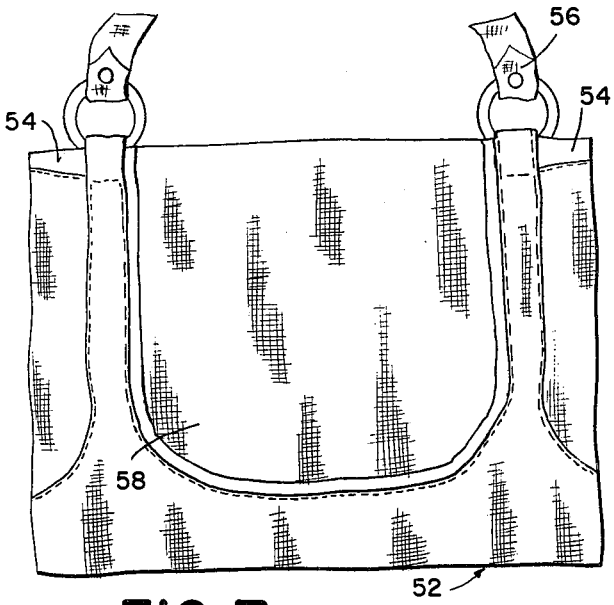
FIG. 7
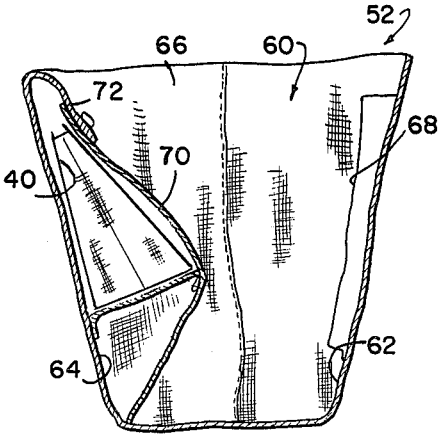
FIG. 8

PURSE APPARATUS

BACKGROUND OF THE INVENTION

Three related problems exists with women's purses, and those problems are solved by the present unitary invention. Dress and custom demand that a purse be appropriate for the attire worn by a person. Changing purses requires much time, and is often done hurriedly under a pressure to meet deadlines and appointments. Purses are susceptible to pickpockets because of their carriage on an external readily accessible part of the bearer. For the same reason, purses are readily vulnerable to the quick assaults of purse snatchers. The present invention attacks these problems.

Some attempts have been made to provide a purse which is suitable for many occasions. Most of these attempts focus upon the changing of exterior covers for purses. However, the covers are just that, and appear in use as covers.

A purse has been marketed with removable, washable linen covers. The purse was a small purse with zipper closings on the base purse at the top. The cover did not fasten to the base purse, but the two parts were held together by straps on the cover.

Another purse had a leather purse with an additional flat piece of leather which was reversible and which wrapped around the purse and fastened at the top through brass rods. The opening was at the top. Neither the ends of the purse or the straps were covered by the wrap.

Before filing the application, the applicant caused a search to be made in the Patent Office. The search was conducted in Official U.S. Patent Office Classification of Inventions, and especially in class 150, subclasses 28, 30, 31, 34, 35, 36, 42, 43, 45, 46 and 47, and in class 63, subclasses 3–11. The following patents were selected as examples of the most pertinent patents which were found. U.S. Pat. No. 2,059,022 describes a cover for a flat purse. There is no bag. The purse is not the cover. Sides of the purse are exposed through the cover. Closure features are not found on the cover.

U.S. Pat. No. 2,479,263 has a cover which fits over a purse which has a closing feature and straps connected to the purse. The cover is not the purse, but is simply a loose cover.

In U.S. Pat. No. 2,326,615 a loose cover has a means for joining to an inner purse. The cover is not the purse, but is simply a cover. Ends of the purse are exposed.

U.S. Pat. No. 2,428,682 in an example of purses similar to other purses of the prior art.

U.S. Pat. No. 2,107,347 shows a reversible purse cover, but the cover is not a purse, and does not operate in the same manner as the present invention.

U.S. Pat. No. 2,068,507 shows a prominently attached reversible cover for changing purse appearance. There is no liner and purse as in the present invention.

A replaceable flap that snaps on both sides of a purse is found in U.S. Pat. No. 2,080,453. That flap permits entry from both sides of a purse. There is no separable liner.

U.S. Pat. No. 237,890 describes a purse within a purse, the outer purse having an elastic band.

U.S. Pat. No. 2,318,563 describes a unique flap arrangement.

SUMMARY OF THE INVENTION

Broad objects of the invention are accomplished by providing a purse apparatus with a soft bag configured for receiving and tightly enclosing an upward opening purse insert.

In a preferred form of the invention, the purse apparatus has a complete insert which holds all of the materials within a purse in an organized manner. The insert is formed of two rigid side walls which are hinged to a bottom wall so that the purse may open at the top for access to a plurality of inside pockets along side walls, and a broad based bottom area. The side walls may be brought together at the top so as to form a generally triangular cross-section with a flat bottom and an upward apex. End walls are provided of soft pliant flexible material preferably having a central vertical seam to promote preferential inward folding along the seam. The side walls and bottom may be constructed of a unitary plastic casting which is scored or slightly reduced at joints of the side wall and bottom wall to promote flexibility, or the side walls and bottom walls may be made of separate plates with separate hinges. The plates may be positioned between two layers of fabric which are stitched between the plates to form the hinge.

In a preferred form of the invention the bag which receives the insert is a bag complete in itself with an upward opening, a means to close the opening, a carrying means to carry the bag, and other functional and decorative features.

In the preferred embodiment, rigid side edges of the insert extend upward beyond upper edges of the flexible end walls. The extended side walls are tucked into downward opening pockets formed along inside upper edges of the sides of the opening of the bag. The bag end walls are seamed or otherwise formed to preferentially bend inward to follow the inward bend of the insert end walls when the purse apparatus is closed.

Different bags are provided. In one form, the bag comprises a large traveling-type bag having an enclosure within the bag for receiving the insert. The enclosure is a bag in itself with side walls, end walls and a flap. The remainder of the bag is configured with pockets and with large open areas for carrying large articles. One end wall of the large bag is configured with a vertical pocket for receiving an umbrella or a large tubular object.

In a preferred embodiment of the invention the purse apparatus bag is closed by a flap which extends from a first upperside edge over the juxtaposed opposite side upper edge to a fastening means on the opposite side. The flap continues over the first side upper edge and downward along the first side to give the appearance as a flap for foiling would-be pickpockets. The pickpocket-foiling false flap may take many designs. The purpose of the designs are to draw to the attention of a would-be pickpocket to that particular flap which appears to be the closure which provides access to the purse.

In a preferred form of the invention, an anchor is connected to one of the rigid plates of the insert, and a chain is connected to the anchor, and has at its remote end a bracelet which firmly connects the purse insert with the arm of the bearer. When the bracelet and insert are separated abruptly, such as by a quick assault of a purse snatcher, an alarm mechanism is activated in the insert. In the preferred form, the alarm is a sunding device activated by a small compressed gas capsule. An irritant or marking medium may be incorporated within the gas to produce a visual, as well as, an audible alarm.

Objects of the invention are as follows:

One object of the invention is the provision of purse apparatus having an insert with rigid side walls, a bottom connecting the side walls and holding the side walls spaced apart at the bottom, and flexible end wall joining the side walls in completion of a upward opening chamber, the side walls having at upper portions thereof means extending above the end walls for joining and attaching the insert to a purse shell.

Another object of the invention is the providing of such a purse apparatus wherein the insert bottom is a rigid bottom wall, and further having parallel hinge means at opposite side edges of the rigid bottom wall for connecting the rigid bottom wall to the rigid side walls.

A further object of the invention is the provision of a purse apparatus insert having rigid side walls and a rigid bottom wall made of layers of fabric, and side wall plates and a bottom wall plate inserted between the layers of fabric, and with hinges comprising interconnections between the layers of fabric, intermediate slightly spaced opposing edges of the side wall plates and the bottom plate.

This invention has as another object the provision of the purse apparatus having a bag for receiving an insert, the bag having spaced opposite side facings joined by a bottom facing and end facings, thereby forming an upward opening receiver for receiving the insert, the receiver having downward facing pockets formed along inward upper edge portions of the facings for receiving upward extensions of the rigid side walls of the insert, which extend above the end walls of the inserts for joining and attaching the receiver to the insert chamber.

This invention has as a further object the provision of purse apparatus having a flap connected to an upper edge portion of a first side facing and extending over the upward opening receiver to the opposite side facing, and fastening means connected to the flap and to the opposite side facing for securing the flap to the opposite side facing in a closing of the upward opening receiver, and a false flap connected to the upper edge portion of the first facing and extending downward over the facing for foiling pickpockets by appearing as a working purse-closing flap.

This invention has as another object the provision of purse apparatus with opposite side facings joined by end facings and a bottom facing wherein one of the side facings has on an inside wall a generally rectangular pocket formed by a first portion of the facing, an inner bottom extending inward from a lower edge of the first portion of the facing, inner end walls extending inward from vertical edge areas of the first portion of the facing, and an inner wall interconnecting the inner bottom and inner end walls, the first facing portion and the inner wall portion having means for joining and holding the insert, and further comprising elongated vertical pocket means mounted on an inside of the facing beside the first facing portion for receiving elongated articles wherein the bag comprises an enlarged travel-type bag with an upward opening receiver for the insert mounted on one inner facing of the bag.

Another object of the invention is the provision of an anchor means connected to a purse insert, a block connected to the anchor means and a flexible body attaching means connected to the block for connecting the purse apparatus with the body.

A further object of the invention is the provision of purse apparatus having alarm means connected to an anchor means in the purse, making noise when a flexible body attaching means pulls a block with respect to the anchor means.

These and other objects and features of the invention are apparent in the disclosure which includes the foregoing and ongoing specification, with the claims, and the drawings.

BRIEF DESCRIPTION OF THE DRAWINGS

FIG. 1 is a perspective view of a purse having an insert partially positioned within a bag.

FIG. 2 is a perspective view of the bag with the insert.

FIG. 3 is a view of the closed bag.

FIG. 4 is an end view of the insert.

FIG. 5 is a cross-sectional and elevation of the purse.

FIG. 6 is a partially cross-sectional perspective view of the purse, including the bag and insert.

FIG. 7 is an elevation of a modified form of the purse.

FIG. 8 is a sectional view of the inside of the purse apparatus of FIG. 7.

FIG. 9 is a partially cut away perspective view showing the anchor and chain.

DETAILED DESCRIPTION OF THE DRAWINGS

Referring to FIG. 1, a purse apparatus is generally indicated by the numeral 1. The bag 10 which is part of the purse apparatus 1 has a first flexible side wall 12 and a second opposite flexible side wall 14. Soft end walls 16 are seamed or creased centrally at 18 to promote inward folding as the upper edges of side walls 12 and 14 are juxtaposed to close the purse.

Bag 10 has a bottom 20 joined to the lower edges of side walls 12 and 14, and end walls 16. An upper rim 22 defines a generally rectangular upward opening of bag 10. Bag 10 is supplied with straps 24 which may be stitched or bonded to the side walls 12 and 14. Buckles 26 which are connected to side wall 12 complete the carrying apparatus for bag 10.

Bag 10 has a flap 28 which extends downward along side 12 from a junction 30 with the upper edge of the purse. Flap 28 may hang loosely, or may be stitched or bonded to side 12, or may be fastened to side 12 with a conventional purse flap fastener. Flap 28 is a false flap which gives the appearance of a true flap to foil would be pickpockets. True flap 32 extends upward from junction 30 and is provided with a conventional purse flap fastening means 34 to engage a complementary fastening means on the outside of wall 14. The false flap 28 is decorated to readily give the appearance of a flap and is intended for carrying away from the body to show the main decorative side of the purse. The true flap 32 is devoid of decoration, and is made to appear plain, being intended for lying close to the body while the purse is carried.

As shown in FIG. 2, the bag 10 has longitudinal downward opening pockets formed along inside upper edges of side walls 12 and 14. Pocket flaps 36 have downward edges 38 which define longitudinal openings as further seen with reference to FIGS. 5 and 6.

The purse apparatus is closed by moving upper edges of side walls 12 and 14 toward each other. The end walls 16 automatically fold inward along fold 18. Flap 32 is then secured with fastener 34, leaving flap 28 outward to give the appearance of a purse opening flap.

The closed bag is shown in FIG. 3.

With particular reference to FIG. 4 and to FIGS. 1 and 6, a purse insert is generally indicated by the numeral 40. Rigid side walls 42 have upper edge portions which fit within the openings formed by edges 38 of downward opening pockets 36 in bag 10. End walls 46 of the insert are flexible, and are centrally folded to preferentially bend inward when upper edges of side walls 42 are drawn together. A rigid bottom wall 48 completes the purse insert 40. Bottom wall 48 is hinged to side walls 42 so that upper edges of the side walls may be freely bent toward each other. In one embodiment, side walls 42 and bottom 48 are made of three rigid plates which are integrally formed with a hinge. In another embodiment, the plates are separate and are interposed between two layers of fabric which are stitched at the hinge to provide the flexibility. In another embodiment, hinges are bonded to the plates near the intersections.

The purse insert 40 is provided with inner pockets 50 to provide the organization of materials carried within the purse. As the insert is changed from purse to purse the contents of the pockets 50 remain intact, together with contents lying on the bottom of the purse.

As shown in FIG. 5, the bag is generally loose and flexible. The flap 32, false flap 28, pocket 36, side wall 12, bottom wall 20 and second side wall 14, and inward pocket flap 36 are formed of supple, flexible material.

As shown in FIG. 6, the insert 40 gives form to the supple purse 10. Upper portions of side walls 42 fit tightly within pocket 36 formed along upper inner edges of bag side walls 12 and 14.

In the embodiment generally indicated by 52 in FIG. 7, a large travel-type bag is provided. The bag has upward opening vertical pockets 54 along side edges for carrying elongated, tubular objects such as umbrellas or magazines. Heavy carrying straps 56 are affixed to the side walls of the bag. A false flap 58 is provided to foil would-be pickpockets. As shown in FIG. 8, travel bag 52 is configured with side walls 62 and 64, and with end walls 66. Pockets are provided in the bag inside, which is generally indicated by the numeral 60. Pocket 68 is formed along the inside of side wall 62, and a pocket 70 is formed on the inside of the opposite wall 64. The pocket 70 has an inner closing flap 72. Purse insert 40 is positioned within the pocket 70 in the large travel bag 52.

As shown in FIG. 9, in the preferred form of the invention, purse insert 40 has an anchor 74 connected to the inside of bottom wall 48. A block 76 is connected to the anchor means, and a flexible chain 78 to the block and is distally connected to a bracelet for wearing on the arm of the bearer. In the preferred form of the invention, gas is stored in a cartridge 80 under high pressure. Slight sliding of block 76 away from cartridge 80 releases the gas with a screaming audible noise. An irritant or visible dye may be incorporated in the gas to augment the sounding alarm.

Although the invention has been described with reference to specific embodiments, it will be obvious to those skilled in the art that modifications and variations of the invention may be made without departing from the spirit and scope of the invention. The scope of the invention is defined in the following claims.

I claim:

1. The purse apparatus comprising a bag having spaced opposite side facings joined by a bottom facing and end facings, thereby forming an upward opening receiver, a flap connected to an upper edge portion of one side facing and extending over the upward opening receiver to another side of the opposite side facing, and fastening means connected to the flap and to the opposite side facing for securing the flap to the opposite side facing in a closing of the upward opening receiver, and a false flap connected to the upper edge portion of said one side facing and extending downward over said one side facing for foiling pickpockets.

2. Purse apparatus of claim 1 further comprising an insert having rigid side walls, a bottom connecting the side walls and holding lower edges of the side walls spaced apart, and flexible end walls joining the side walls in completion of an upward opening chamber, the side walls having upward rigid extensions of the rigid side walls extending above upper extremities of the flexible end walls, for joining and attaching the insert to the bag.

3. The purse apparatus of claim 2 wherein the insert bottom is a rigid bottom wall, and further comprising parallel hinge means at opposite side edges of the rigid bottom wall for connecting th rigid bottom wall to the rigid side walls.

4. The purse apparatus of claim 3 wherein the rigid side walls and rigid bottom wall comprise layers of fabric and side wall plates and a bottom wall plate inserted between the layers of fabric, and wherein the hinge means comprise interconnections between the layers of fabric, intermediate opposing edges of the side wall plates and the bottom plate.

5. The purse apparatus of claim 2, the receiver having means along upper inward portions of side facings for joining and attaching the receiver to the insert.

6. The apparatus of claim 5 wherein the means for joining comprises first and second downward facing pockets formed along inward upper edge portions of the facings for receiving upward extensions of the rigid side walls of the insert, which extend above the end walls of the inserts.

7. The apparatus of claim 2 further comprising an anchor means connected to the insert, a block connected to the anchor means and a flexible body attaching means connected to the block for connecting the purse apparatus with a user's body.

8. The purse apparatus of claim 7 further comprising alarm means connected to the anchor means for making noise when the flexible body attaching means pulls the block with respect to the anchor means.

9. The purse apparatus comprising a bag having spaced opposite side facings joined by a bottom and ends wherein one of the side facings has on an inside wall a generally rectangular pocket formed by a first portion of the side facing, an inner bottom extending inward from a lower edge of the first portion of side the facing, and inner end walls extending inward from vertical edge areas of the first portion of the side facing, and an inner wall interconnecting the inner bottom and inner end walls, the first facing portion and the inner wall portion having means for joining and holding an insert, and further comprising elongated vertical pocket means mounted on an inside of the facing beside the first facing portion for receiving elongated articles wherein the bag comprises an enlarged travel-type bag with an upward opening receiver for the insert mounted on one inner facing of the bag.

10. The purse apparatus comprising a bag for receiving an upward-opening insert chamber, the bag having first and second spaced opposite side facings joined by a bottom facing and end facings, thereby forming a generally rectangular upward-opening receiver for receiving the insert, the receiver having narrow downward facing pocket means along upper inward portions of side facings inward of the end facings for receiving extensions of the insert and thereby joining and attaching the receiver to the insert chamber, a flat connected to an upper edge portion of the first side facing and extending over the upward opening receiver to the opposite side facing, and fastening means connected to the flap and to an exterior of the opposite side facing for securing the flap to the opposite side facing in a closing of the upward opening receiver with the insert therein, and a false flap connected to the upper edge portion of the first facing and extending downward over the first facing for foiling pickpockets by appearing as a true purse-closing flap.

11. Purse apparatus comprising a bag having spaced opposite first and second side facings joined by a bottom facing and end facings, thereby forming an upward opening receiver, a flap connected to an upper edge portion of the first side facing and extending over the upward opening receiver to the opposite side facing, and fastening means connected to the flap and to the exterior of the second opposite side facing for securing the flap to the second side facing in a closing of the upward opening receiver, and a false flap connected to the upper edge portion of the first facing and extending downward over the first facing for foiling pickpockets by appearing as a purse-closing flap.

* * * * *